US011155084B2

(12) United States Patent
Kudo et al.

(10) Patent No.: US 11,155,084 B2
(45) Date of Patent: Oct. 26, 2021

(54) LIQUID EJECTING HEAD AND MANUFACTURING METHOD THEREOF

(71) Applicant: CANON KABUSHIKI KAISHA, Tokyo (JP)

(72) Inventors: Satoshi Kudo, Machida (JP); Hisashi Fukai, Yokohama (JP); Hiroyuki Shimoyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 16/845,628

(22) Filed: Apr. 10, 2020

(65) Prior Publication Data

US 2020/0331261 A1 Oct. 22, 2020

(30) Foreign Application Priority Data

Apr. 17, 2019 (JP) ..... JP2019-078629

(51) Int. Cl.
*B41J 2/14* (2006.01)
*B41J 2/16* (2006.01)

(52) U.S. Cl.
CPC ..... *B41J 2/14024* (2013.01); *B41J 2/1404* (2013.01); *B41J 2/1623* (2013.01)

(58) Field of Classification Search
CPC .... B41J 2/14024; B41J 2/1623; B41J 2/1404; B41J 2202/19; B41J 2202/20; B41J 2/1601; B41J 2/1607
See application file for complete search history.

(56) References Cited

U.S. PATENT DOCUMENTS

2015/0321475 A1* 11/2015 Tatsumi ..... F16B 11/00 347/47

FOREIGN PATENT DOCUMENTS

JP 2007050662 A 3/2007

OTHER PUBLICATIONS

IP.com search (Year: 2021).*
IP.com2 search (Year: 2021).*

* cited by examiner

*Primary Examiner* — Lisa Solomon
(74) *Attorney, Agent, or Firm* — Canon U.S.A., Inc. IP Division

(57) ABSTRACT

An element substrate is bonded to a support substrate with high positional accuracy. A manufacturing method of the liquid ejecting head includes curing a first adhesive, which is in contact with an element substrate and a support substrate, at a first temperature to perform first temporary fixing, heating a second adhesive, which is in contact with the element substrate and the support substrate, to a second temperature higher than the first temperature so as to cure the second adhesive and perform second temporary fixing and heating a third adhesive, which is in contact with the element substrate and the support substrate, to a third temperature higher than the second temperature so as to cure the third adhesive and bond the element substrate to the support substrate. An elastic modulus of the second adhesive is larger than an elastic modulus of the first adhesive at the second temperature.

19 Claims, 11 Drawing Sheets

LIQUID EJECTING HEAD AND MANUFACTURING METHOD THEREOF

BACKGROUND OF THE DISCLOSURE

Field of the Disclosure

The present disclosure relates to a liquid ejecting head and a manufacturing method thereof, and more particularly, to a method of bonding an element substrate to a support substrate.

Description of the Related Art

In an ink jet recording apparatus, an element substrate including an ejection orifice for ejecting ink may be bonded to a support substrate by an adhesive. In order to secure a good recording quality, it is important that the element substrate is accurately bonded to the support substrate at a predetermined position of the support substrate. As the adhesive, a room temperature curing type adhesive such as a moisture curing type adhesive or a two-liquid type adhesive can be used. However, there is a problem in productivity because the room temperature curing type adhesive takes a long time to be completely cured. Japanese Patent Application Laid-Open No. 2007-50662 discloses a method for manufacturing an ink jet head using a photo-curable adhesive and a thermosetting adhesive. The photo-curable adhesive or thermosetting adhesive is provided between a base substrate (support substrate) formed of a transparent resin material and a recording head unit (element substrate) and ultraviolet rays or laser light is emitted from a surface opposite to a bonding surface of the base substrate with respect to the recording head unit.

In the method described in Japanese Patent Application Laid-Open No. 2007-50662, the support substrate needs to be formed of a light-transmitting material. However, the support substrate needs to satisfy many requirements such as rigidity, processing accuracy and an ink resistance, and thus, a degree of freedom of the material is greatly limited. Accordingly, a method of heating the entire support substrate to which a thermosetting adhesive is applied and on which the element substrate is mounted so as to cure the adhesive is used. According to this method, the limitation of the material decreases, and thus, the above-described problem can be easily avoided. Generally, the entire heating of the element substrate and the support substrate is performed by a dedicated curing furnace (heating furnace). In this case, a process of transporting the support substrate to which the thermosetting adhesive is applied and on which the element substrate is mounted to a curing furnace so as to install the support substrate occurs. In this case, in order to prevent a displacement of the element substrate due to vibrations or impacts, the element substrate may be temporarily fixed to the support substrate in advance.

Meanwhile, the element substrate is deformed by thermal expansion during heating. The element substrate is deformed in a predetermined pattern according to a planar shape thereof and a temporary fixing position. However, depending on conditions, the element substrate is not thermally expanded in a similar shape but a shape of the element substrate itself may be changed. Accordingly, a center line of the element substrate rotates and a displacement of the ejection orifice with respect to the support substrate occurs, which may have a great effect on recording quality.

SUMMARY OF THE DISCLOSURE

An aspect of the present disclosure to provide a manufacturing method of a liquid ejecting head capable of bonding an element substrate to a support substrate with high positional accuracy.

A manufacturing method of a liquid ejecting head according to the present disclosure includes: curing a first adhesive, which is in contact with an element substrate having an ejection orifice from which a liquid is ejected and a support substrate, at a first temperature to perform first temporary fixing of the element substrate to the support substrate; heating a second adhesive, which is in contact with the element substrate and the support substrate subjected to the first temporary fixing, to a second temperature higher than the first temperature so as to cure the second adhesive and perform second temporary fixing of the element substrate to the support substrate; and heating a third adhesive, which is in contact with the element substrate and the support substrate subjected to the second temporary fixing, to a third temperature higher than the second temperature so as to cure the third adhesive and bond the element substrate to the support substrate, in which an elastic modulus of the second adhesive is larger than an elastic modulus of the first adhesive at the second temperature.

Further features and aspects of the present disclosure will become apparent from the following description of example embodiments with reference to the attached drawings.

DESCRIPTION OF THE EMBODIMENTS

Figure 1A:
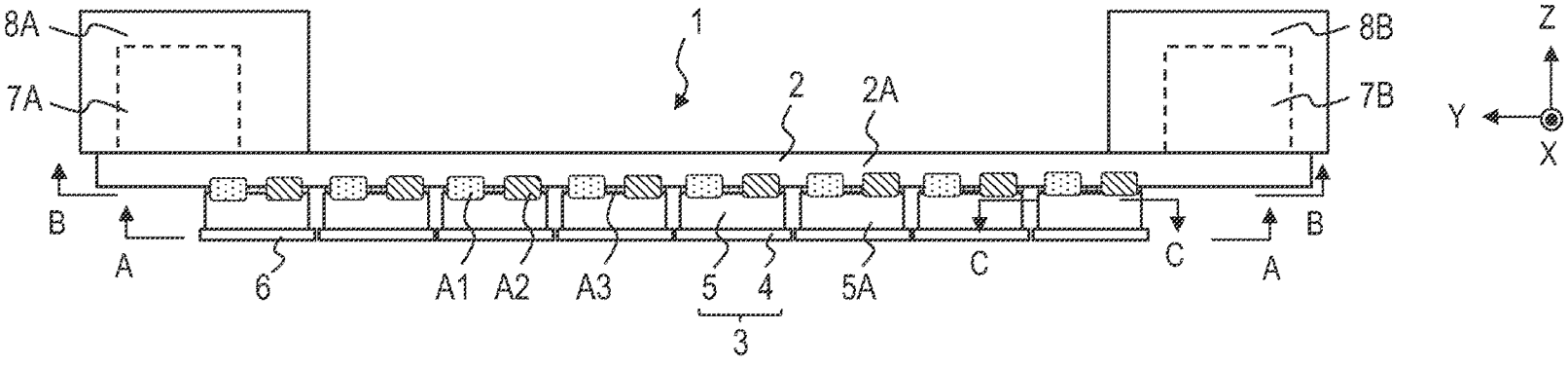
FIGS. 1A, 1B and 1C are schematic views of a liquid ejecting head according to a first example embodiment.

Several embodiments of the present disclosure will be described with reference to the drawings. The present embodiment relates to a line type liquid ejecting head having a length substantially equal to a width of a recording medium. However, the present disclosure can be also applied to a serial type liquid ejecting head which performs recording while scanning a recording medium. The present embodiment relates to an ink jet recording head which ejects ink. However, the present disclosure can also be applied to a liquid ejecting head which ejects a liquid other than ink. In the drawings and the following descriptions, an X direction is a lateral direction of a support substrate and corresponds to a conveying direction of the recording medium. A Y direction is a longitudinal direction of the support substrate and corresponds to a width direction of the recording medium. The Y direction is orthogonal to the X direction. A Z direction is a direction orthogonal to the X direction and the Y direction.

Figure 1B:
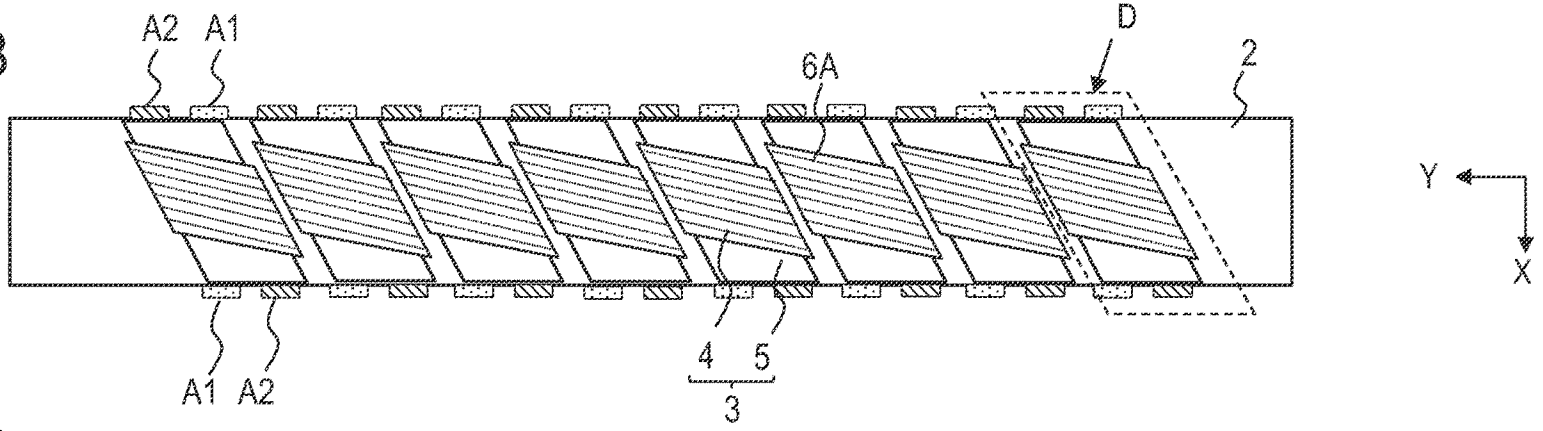
Figure 1C:
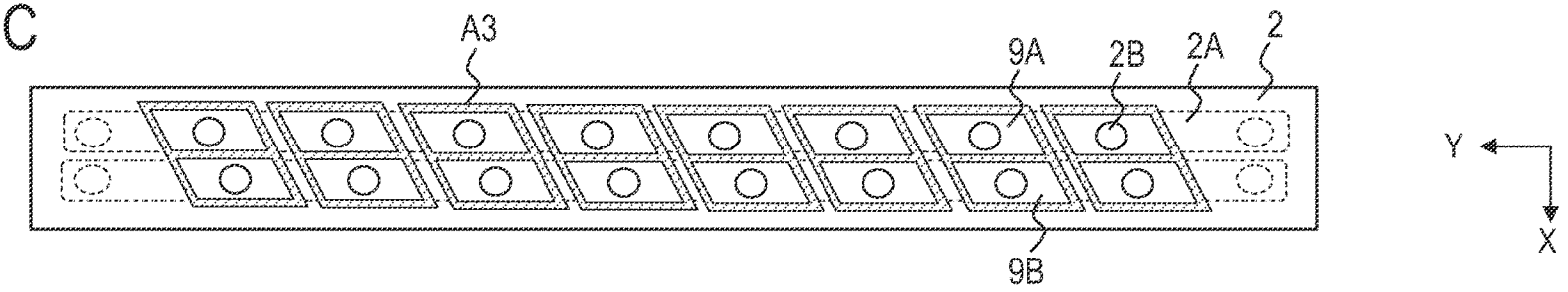
Figure 2A:
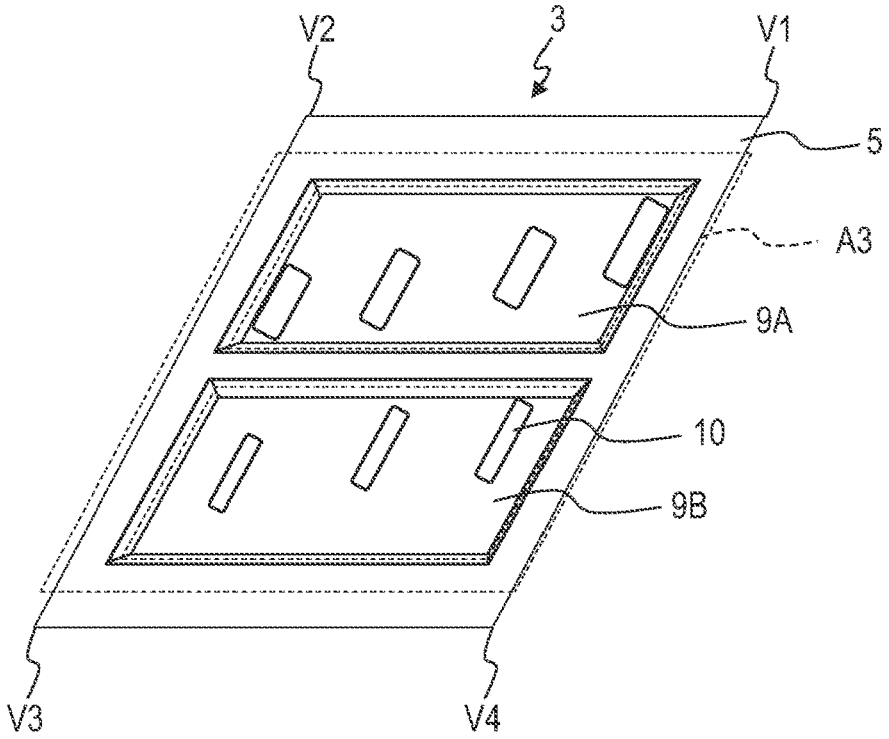
FIGS. 2A and 2B are enlarged views of an example element substrate of the liquid ejecting head illustrated in FIGS. 1A to 1C.
Figure 2B:
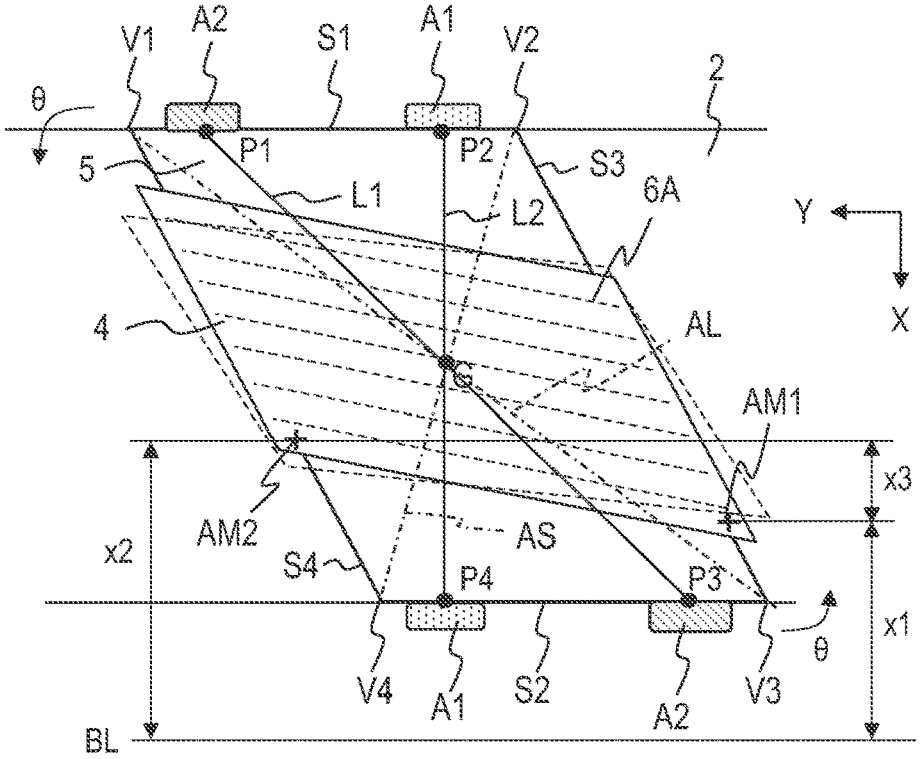

First, an example of a liquid ejecting head to which the present embodiment is applied will be described with reference to FIGS. 1A to 2B. FIG. 1A is a side view of a liquid ejecting head 1. FIG. 1B is a plan view of an ejection orifice surface of the liquid ejecting head 1 taken along line A-A in FIG. 1A and FIG. 1C is a plan view of a support substrate 2 and a third adhesive A3 taken along line B-B in FIG. 1A. FIG. 2A is a plan view of an element substrate 3 taken along line C-C in FIG. 1A and FIG. 2B is an enlarged view of a portion D in FIG. 1B. The liquid ejecting head 1 has the support substrate 2 which is elongated in the Y direction and a plurality of the element substrates 3 which is supported by the support substrate 2. The support substrate 2 has a function as a flow path member which forms an ink flow path 2A for supplying ink to the element substrate 3 and a function as a heat insulating member for keeping a temperature of the ink constant. An opening 2B for supplying the ink to the element substrate 3 is provided on a surface of the support substrate 2 facing the element substrate 3. Ink supply units 7A and 7B and attachment portions 8A and 8B for attaching the support substrate 2 to a recording apparatus main body (not illustrated) are provided on both sides of a surface opposite to the surface of the support substrate 2 facing the element substrate 3 in the Y direction. An electrical wire (not illustrated) for supplying a control signal and driving power for an energy generating element is provided between the recording apparatus main body and the support substrate 2. The support substrate 2 is generally rectangular when viewed in the Z direction, but may have a parallelogram shape which matches a shape of the element substrate 3.

The plurality of element substrates 3 are disposed along the longitudinal direction (Y direction) of the support substrate 2. Each element substrate 3 has a substrate 4 and a support substrate 5 (another support substrate). The substrate 4 is obtained by stacking an ejection orifice forming member (not illustrated) in which an ejection orifice 6 for ejecting the ink is formed and a base (not illustrated) having an energy generating element (not illustrated) which generates energy for ejecting the ink. The energy generating element is a heating resistance element, but may be a piezo element or other elements. The support substrate 5 supports the substrate 4 and is bonded to the long support substrate 2. The substrate 4 is formed in a parallelogram of which four vertices are non-perpendicular and the plurality of ejection orifices 6 forms ejection orifice arrays 6A inclined with respect to the Y direction.

As illustrated in FIG. 2A, two concave portions 9A and 9B through which ink flows and through holes 10 which communicate with the concave portions 9A and 9B and supply ink to the substrate 4 are formed in the support substrate 5. A shape of the support substrate 5 when viewed in the Z direction is a parallelogram of which four vertices are non-perpendicular so as to match the substrate 4. Referring to FIG. 2B, the support substrate 5 has first to fourth vertices V1 to V4, the first and third vertices V1 and V3 face each other and the second and fourth vertices V2 and V4 face each other. A first side S1 connecting the first vertex V1 and the second vertex V2 to each other and a second side S2 connecting the third vertex V3 and the fourth vertex V4 to each other are parallel to each other and are parallel in the Y direction. A third side S3 connecting the second vertex V2 and the third vertex V3 to each other and a fourth side S4 connecting the fourth vertex V4 and the first vertex V1 to each other are parallel to each other. A line (hereinafter, referred to as a major axis AL) connecting the first vertex V1 and the third vertex V3 to each other is longer than a line (hereinafter, referred to as a minor axis AS) connecting the second vertex V2 and the fourth vertex V4 to each other.

Each of the plurality of element substrates 3, more specifically, each of the plurality of support substrates 5 is bonded to the support substrate 2 by an adhesive. The support substrate 5 is temporarily fixed to the support substrate 2 by first and second adhesives A1 and A2 and is bonded to the support substrate 2 by a third adhesive A3. As illustrated in FIG. 1A, the first and second adhesives A1 and A2 are formed so as to straddle a side surface 2A of the support substrate 2 and a side surface 5A of the support substrate 5. The side surface 2A of the support substrate 2 is a surface which is adjacent to a surface of the support substrate 2 facing the support substrate 5 and extends in the Y direction. The side surface 5A of the support substrate 5 is a surface which is adjacent to a surface of the support substrate 5 facing the support substrate 2 and extends in the Y direction. As illustrated in FIGS. 1C and 2A, the third adhesive A3 is formed around the concave portion 9 between the element substrate 3 (support substrate 5) and the support substrate 2.

First Example Embodiment

Figure 3A:
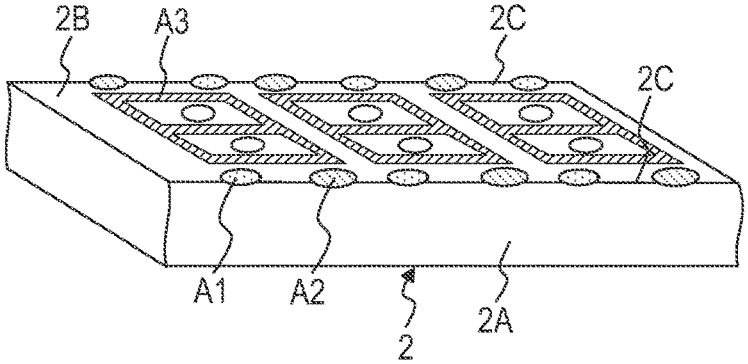
FIGS. 3A, 3B and 3C are step diagrams of an example manufacturing method of the liquid ejecting head illustrated in FIGS. 1A to 1C.
Figure 3B:
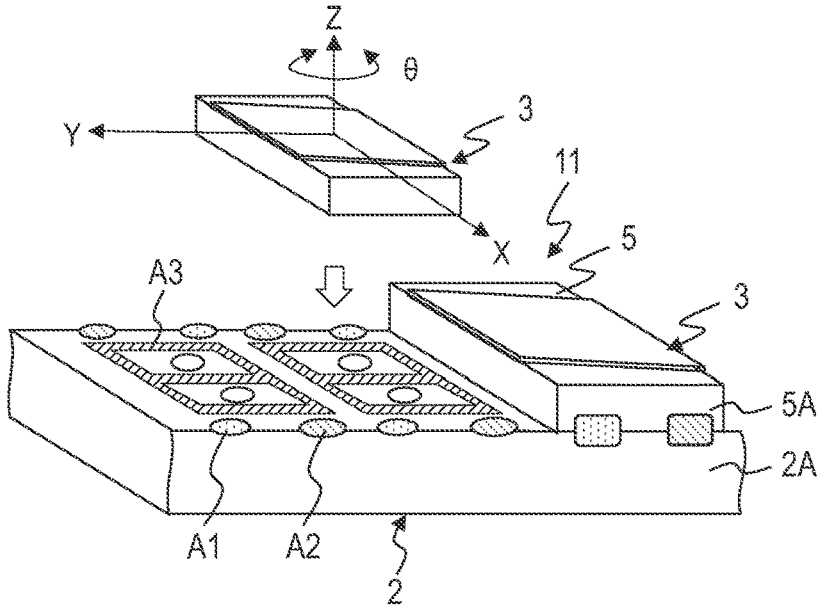
Figure 3C:
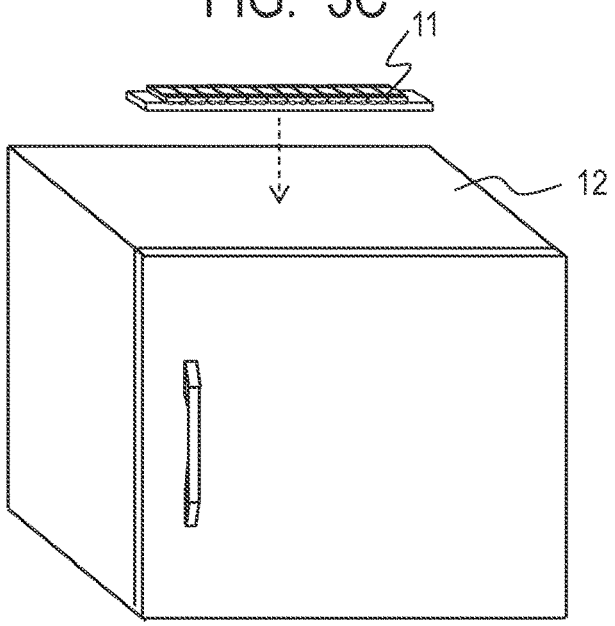
Figure 4:
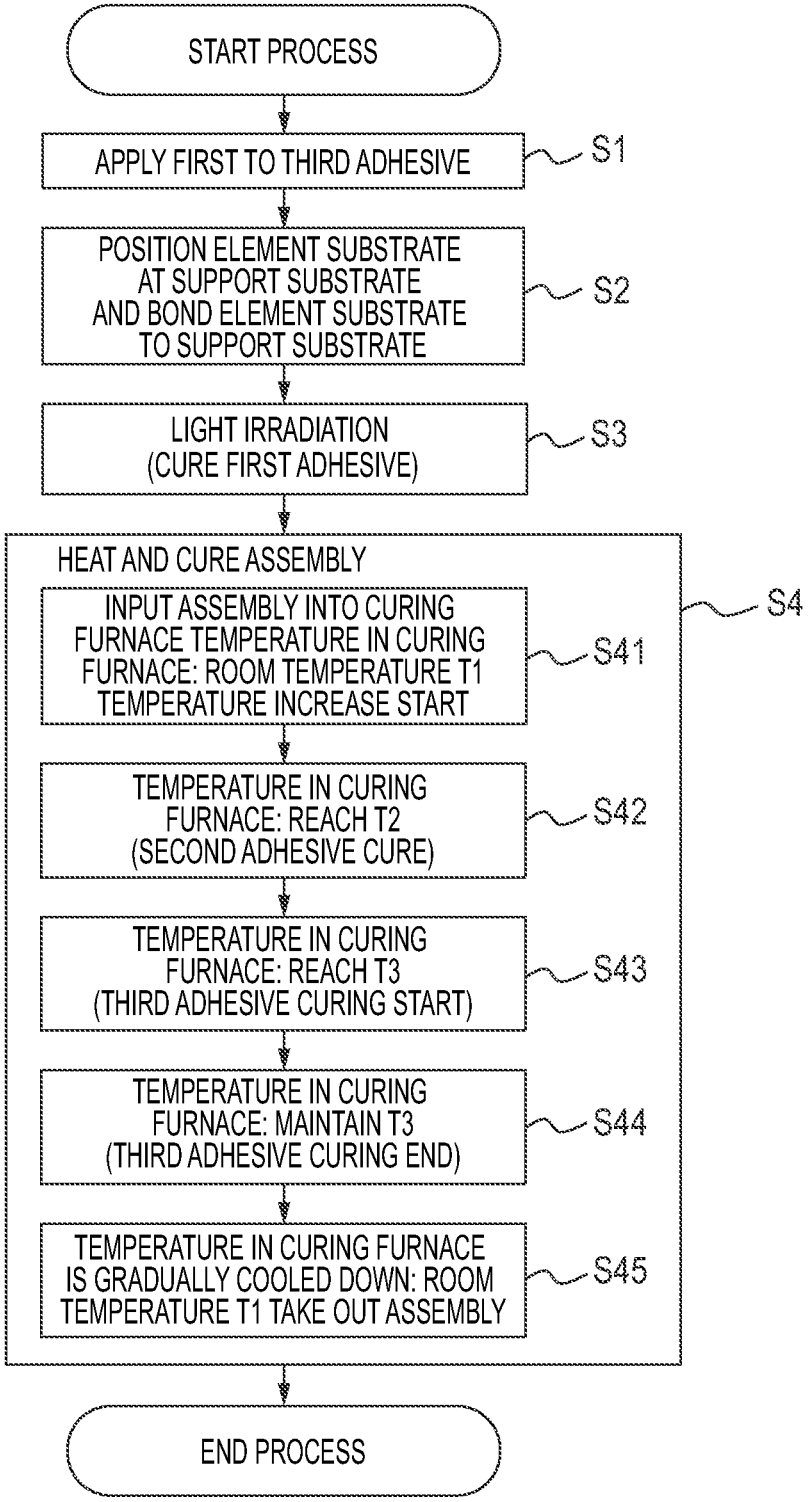
FIG. 4 is a flowchart of the manufacturing method of the liquid ejecting head illustrated in FIGS. 1A to 1C.

A method for bonding the element substrate 3 to the support substrate 2 according to a first embodiment will be described. FIGS. 3A to 3C are step diagrams illustrating the bonding method and FIG. 4 is a flowchart illustrating the bonding method. In the following descriptions, the support substrate 2 and the plurality of element substrates 3 mounted on the support substrate 2 are collectively referred to as an assembly 11.

First, as illustrated in FIG. 3A, first to third liquid adhesives A1 to A3 are applied to the support substrate 2 at positions different from each other (Step S1). In the present embodiment, the first to third adhesives A1 to A3 are formed between the support substrate 2 and the element substrate 3 before first temporary fixing is performed. Specifically, the third adhesive A3 is applied to a surface (hereinafter, referred to as a bonding surface 2B) of the support substrate 2 facing the element substrate 3 by an application robot (not illustrated) such as a dispenser. Thereafter, a small amount of the first and second adhesives A1 and A2 is applied along both long sides 2C of the bonding surface 2B of the support substrate 2 by the application robot (not illustrated) such as the dispenser. Each of the first and second adhesives A1 and A2 is formed at each of both long sides 2C of the bonding surface 2B of the support substrate 2 for each element substrate 3. The first to third adhesives A1 to A3 are collectively applied to a portion of the support substrate 2 to which each element substrate 3 is bonded. The order in which the first to third adhesives A1 to A3 are applied is not limited to the above order. For example, the third adhesive A3 may be applied after the first and second adhesives A1 and A2 are applied. Some or all of the first to third adhesives A1 to A3 may be applied to a surface of the support substrate 5 bonded to the support substrate 2.

As illustrated in FIG. 2B, the first adhesives A1 are provided at a second position P2 of the first side S1 close to the second vertex V2 and a fourth position P4 of the second side S2 close to the fourth vertex V4. The second adhesives A2 are provided at a first position P1 of the first side S1 close to the first vertex V1 and a third position P3 of the second side S2 close to the third vertex V3. A first straight line L connecting the first position P1 and the third position P3 to each other and a second straight line L2 connecting the second position P2 and the fourth position P4 to each other pass through a center of gravity G of the support substrate 5. The second straight line L2 is orthogonal to the first and second sides S1 and S2. In other words, the first adhesives A1 are disposed at positions closest to the center of gravity G of the element substrate 3 on each long side 2C of the bonding surface 2B and the second adhesives A2 are disposed at positions further away from the center of gravity G of the element substrate 3 than the first adhesives A1.

The positions of the first and second adhesives A1 and A2 are not limited to this. However, in the present embodiment, the first and second adhesives A1 and A2 are provided at the positions due to a layout of the liquid ejecting head 1. When the element substrate 3 is pressed against the support substrate 2 in a step to be described later, the first to third adhesives A1 to A3 spread. Accordingly, there is a possibility that the first and second adhesives A1 and A2 come into contact with the third adhesive A3 and are mixed with the third adhesive A3. In this case, there is a possibility that curing occurs due to a chemical reaction in the contacted or mixed portion, conversely, the curing does not occur due to heating, or original adhesive strength is not realized. The first and second adhesives A1 and A2 are provided on both long sides 2C of the support substrate 2. Accordingly, a separation distance between the first and second adhesives A1 and A2 and the third adhesive A3 is easily secured.

The first adhesive A1 is used as a temporary fixing material which prevents the element substrate 3 from being displaced with respect to the support substrate 2 afler the element substrate 3 is mounted on the support substrate 2 and before the element substrate 3 is transported to the curing furnace 12 in that state. In the present embodiment, the first adhesive A1 is an ultraviolet curable resin and the first adhesive A1 may be any one as long as the first adhesive A1 contains at least a photocurable component. The first adhesive A1 is cured at a relatively short time by ultraviolet irradiation. Accordingly, a time until the assembly 11 is installed in the curing furnace 12 can be shortened. In the present embodiment, each of the second and third adhesives A2 and A3 is a thermosetting resin and each of the second and third adhesives A2 and A3 may be any one as long as each adhesive contains at least a thermosetting component. The second adhesive A2 is used as a temporary fixing material which suppresses the displacement and thermal deformation of the element substrate 3 when the temperature of the curing furnace 12 is increased until the third adhesive A3 is cured. The third adhesive A3 is used as a main bonding material for bonding the element substrate 3 to the support substrate 2 and is also used as a flow path wall of an ink flow path. Therefore, an application area of the third adhesive A3 on the bonding surface 2B is larger than an application area of the first adhesive A1 on the bonding surface 2B and an application area of the second adhesive A2 on the bonding surface 2B.

Next, the element substrate 3 is mounted on (attached to) the support substrate 2 and pressed against the support substrate 2 (Step S2). First, the element substrate 3 is held by a mounting device (not illustrated), alignment in XYθ directions is performed on the element substrate 3 by image processing above a mounting position and the element substrate 3 is mounted on the support substrate 2 at a low speed. The first to third adhesives A1 to A3 are in contact with the element substrate 3 and the support substrate 2. After the mounting, a slight displacement is confirmed, and if there is a displacement, the alignment is repeated until desired accuracy is obtained. A portion of each of the first and second adhesives A1 and A2 protrude to the side surface 2A of the support substrate 2 and the side surface 5A of the support substrate 5 and the remainder thereof spreads to a space between the element substrate 3 and the support substrate 2. The third adhesive A3 spreads to a space between the support substrate 2 and the element substrate 3. Next, in a state where the element substrate 3 is pressed against the support substrate 2 by a finger (not illustrated) of the mounting device, the first adhesive A1 is locally irradiated with light to cure the first adhesive A1. (Step S3). The first adhesive A1 is cured at a first temperature (room temperature), and thus, the first temporary fixing of the element substrate 3 to the support substrate 2 is performed. Thereafter, the finger is retracted and the pressing of the element substrate 3 is released. Steps S2 and S3 are repeated for each element substrate 3. Accordingly, the assembly 11 of the support substrate 2 and the plurality of element substrates 3 is obtained, in which all the element substrates 3 are mounted on the support substrate 2 and temporarily fixed by the first adhesives A1.

Figure 5:
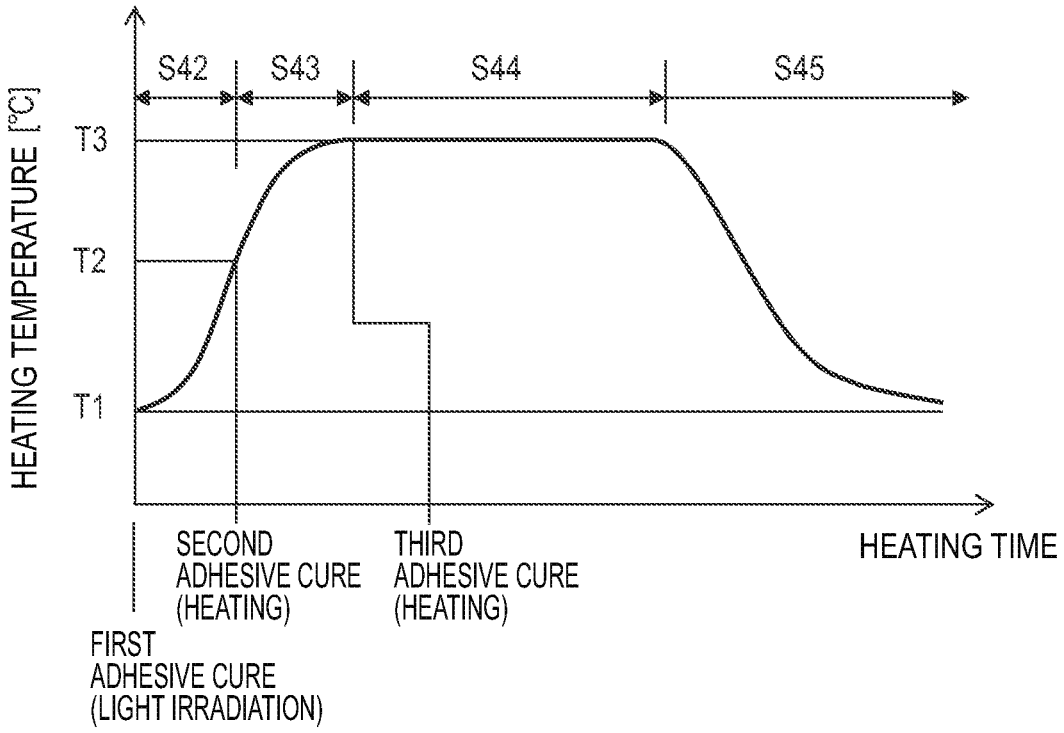
FIG. 5 is a graph illustrating a relationship between a time and heating temperature.

Next, the assembly 11 is heated (Step S4). Specifically, first, as illustrated in FIG. 3C, the assembly 11 is transported and installed in the curing furnace 12 (Step S41). The element substrate 3 is temporarily fixed by the photo-curable first adhesives A1 which are cured at the room temperature. Accordingly, it is possible to suppress the displacement caused by vibrations or impacts during the transport or installation. Next, the curing furnace 12 is heated from the first temperature T1 to the third temperature T3 and the second adhesives A2 and the third adhesives A3 are sequentially cured. FIG. 5 illustrates a relationship between a heating time and a heating temperature. If the temperature of the curing furnace 12 increases from the first temperature T1 to a second temperature T2, the second adhesives A2 are cured and second temporary fixing of the element substrate 3 to the support substrate 2 is performed (Step S42). If the temperature of the curing furnace 12 further increases to the third temperature T3, the third adhesives A3 are cured and the element substrates 3 are bonded to the support substrate 2 (Step S43). The third temperature T3 is maintained until the third adhesives A3 are completely cured (Step S44), and thereafter, the curing furnace 12 is gradually cooled down to the room temperature and the assembly 11 is taken out of the curing furnace 12 (Step S45). Accordingly, a process of bonding the element substrate 3 to the support substrate 2 is completed.

Figure 6A:
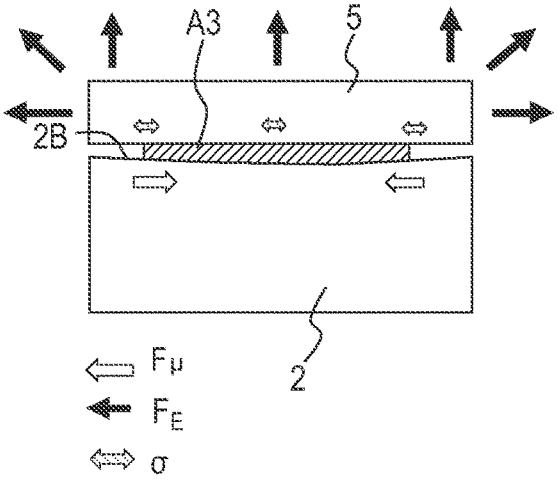
FIGS. 6A, 6B and 6C are conceptual diagrams illustrating a force applied to the element substrate and a thermal deformation of the element substrate.

Next, effects of the present embodiment will be described. FIG. 6A is a side view of the support substrate 5 and the support substrate 2 and schematically illustrates a force applied to the support substrate 5 during heating. It is assumed that there is no first and second adhesives A1 and A2. The support substrate 5 receives a force $F_E$ caused by thermal expansion of the support substrate 5, a frictional force Fμ caused by the third adhesive A3 and an internal stress σ of the third adhesive A3 and the forces may cause the displacement of the support substrate 5. The forces are ideally balanced in a right-left direction and an up-down direction, but may actually be uneven in the right-left direction and the up-down direction due to dimensional accuracy of a member. FIG. 6A illustrates an example in which a thickness of the third adhesive A3 is non-uniform due to variations in flatness of the bonding surface 2B. In this case, $F_E$, Fμ and a are changed depending on the location. Accordingly, the support substrate 5 may be thermally deformed into an irregular shape regardless of an original shape.

Figure 6B:
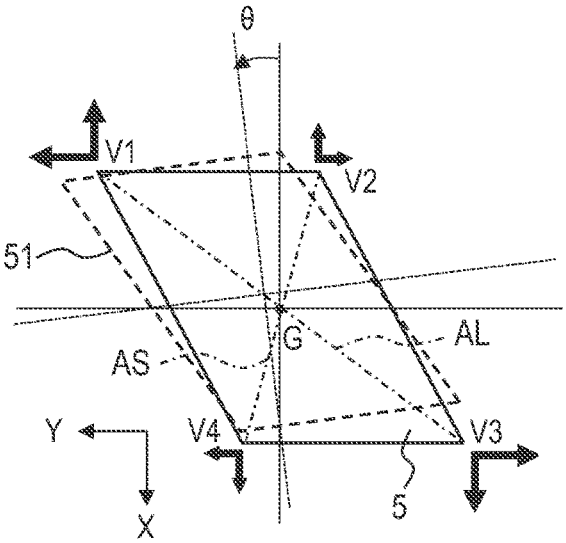

Further, in a case where the support substrate 5 has the shape having the major axis AL and the minor axis AS as in the present embodiment, as illustrated in FIG. 6B, an amount of thermal deformation at each vertex may not be uniform. The amount of thermal expansion of the support substrate 5 is greater in the major axis AL direction than in the minor axis AS direction. Accordingly, in the first vertex V1 and the third vertex V3 on the major axis AL, the amount of thermal deformation is large and in the second vertex V2 and the fourth vertex V4 on the minor axis AS, the amount of thermal deformation is small. FIG. 6B schematically illustrates X and Y components of the amounts of thermal deformation at the first to fourth vertices V1 to V4. As a result, as illustrated by a broken line 51, the support substrate 5 rotates in the counterclockwise direction around the center of gravity G thereof and the displacement of the support substrate 5 occurs not only in the X and Y directions but also in a rotational direction θ. If the temperature reaches the third temperature T3, the support substrate 5 is fixed to the support substrate 2 in a state of being displaced. Accordingly, the displacement remains even when the temperature is returned to the room temperature. As a result, the ejection orifice arrays 6A (see FIG. 2B) rotate with respect to the support substrate 2, which may largely affect recording quality.

Figure 6C:
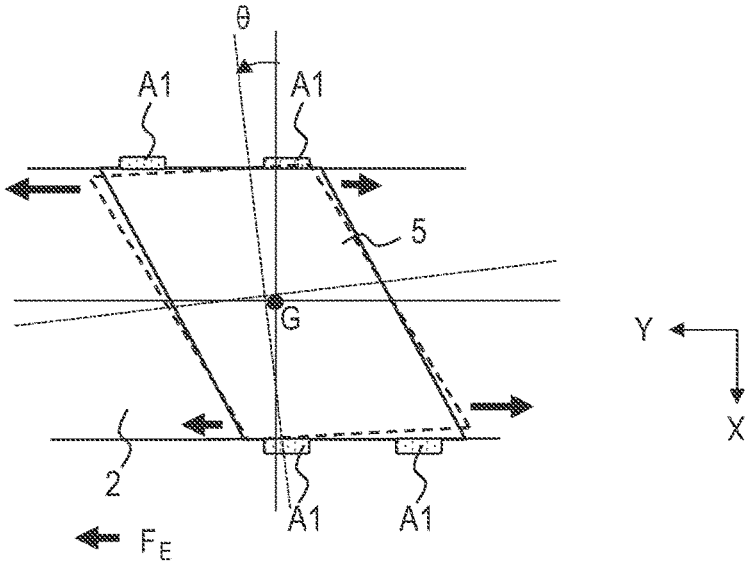

As illustrated in FIG. 2A, even if an outer shape of the support substrate 5 is a parallelogram, an inner shape may be asymmetric. In the illustrated example, the disposition of the through holes 10 through which ink flows is asymmetric in a fluid design and three-dimensional shapes are different from each other between upper and lower portions. In this case, although not illustrated, there is a possibility that thermal deformation patterns are different from each other between the upper and lower portions. FIG. 6C illustrates an example in which four first adhesives A1 are provided on an outer peripheral portion of the support substrate 5. In the present example, the support substrate 5 is restrained by the first adhesives A1. However, as will be described later, the first adhesive A1 is softened as the temperature increases. Accordingly, the thermal deformation of the support substrate 5 cannot be sufficiently restrained and rotational deformation of the support substrate 5 still occurs.

Figure 7:
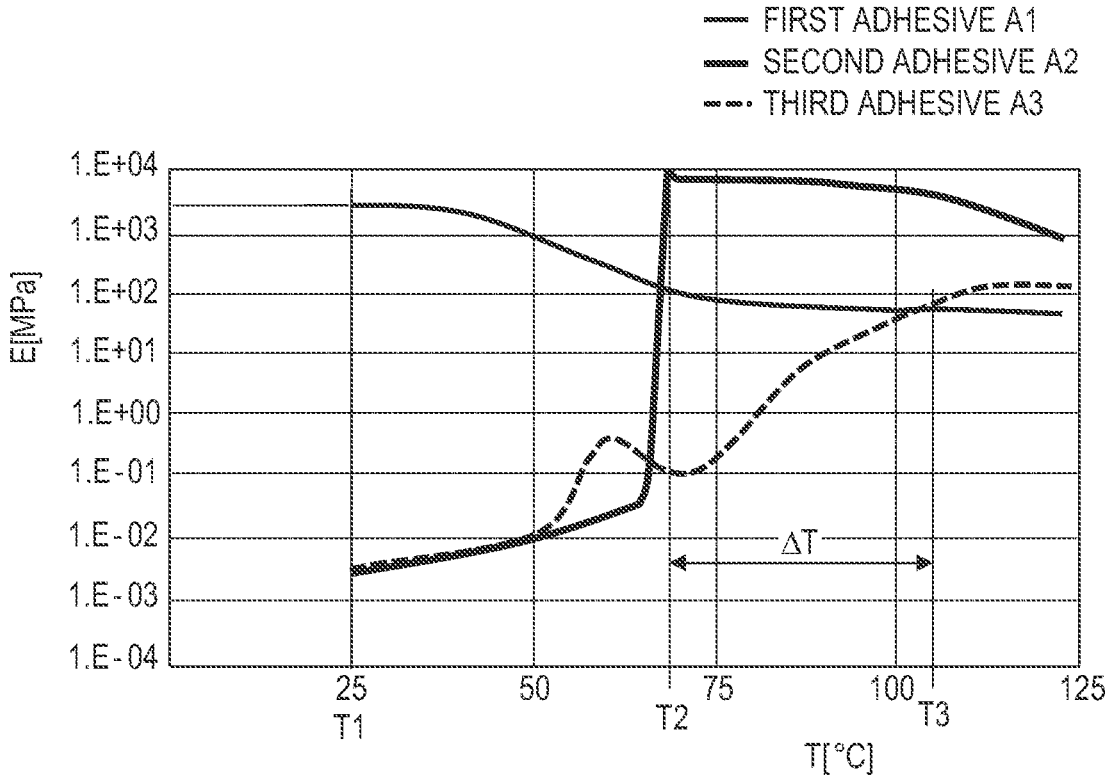
FIG. 7 is a graph illustrating an example of a measurement result of temperatures and elastic modulus of first to third adhesives.

Meanwhile, in the present embodiment, the second adhesive A2 is used as a temporary fixing material. FIG. 7 illustrates an example in which a relationship (temperature curing properties) between the temperatures and the elastic modulus (longitudinal elastic modulus E) of the first to third adhesives A1 to A3 is measured by an analyzer. A horizontal axis indicates the temperature and a vertical axis indicates the elastic modulus. The elastic modulus of the third adhesive A3 gradually increases immediately after the third adhesive A3 is applied (first temperature T) and is substantially constant at the third temperature T3 (about 105° C.). The third adhesive A3 is gradually heated and cured, and thus, the elastic modulus thereof also gradually increases. Regarding the third adhesive A3, a state in which the elastic modulus is 50% or more of a maximum elastic modulus (the maximum longitudinal elastic modulus E) is referred to as a cured state. That is, the third temperature T3 satisfies curing conditions, but does not necessarily mean that the third adhesive A3 is completely cured. Meanwhile, the first adhesive A1 is photocured at the first temperature T1 before curing, but the elastic modulus of the first adhesive A1 decreases as the temperature increases. That is, the elastic modulus of the first adhesive A1 at the second temperature T2 is smaller than the elastic modulus of the first adhesive A1 at the first temperature T1. The elastic modulus continuously decreases to about 70° C. and remains substantially constant even when the first adhesive A1 is further heated. A curing temperature (second temperature T2) of the second adhesive A2 is about 70° C. and the elastic modulus of the second adhesive A2 sharply increases from around 65° C. As a result, the elastic modulus of the second adhesive A2 at the second temperature T2 is larger than the elastic modulus of the first adhesive A1 at the second temperature T2. The elastic modulus of the second adhesive A2 is larger than the elastic modulus of the first adhesive A1 at any temperature from the second temperature T2 to the third temperature T3.

According to the present embodiment, the second adhesive A2 is cured before the third adhesive A3 is cured. Accordingly, the support substrate 5 is strongly restrained by the support substrate 2 between the second temperature T2 and the third temperature T3 (temperature range ΔT illustrated in FIG. 7) and the thermal deformation of the support substrate 5 is suppressed. In other words, in a case where there is no second adhesive A2, the support substrate 5 is temporarily fixed only by the first adhesive A1 of which the elastic modulus and the temperature decrease until the curing of the third adhesive A3 starts. Therefore, if the support substrate 5 is thermally deformed due to an increase in temperature, the thermal deformation of the support substrate 5 cannot be sufficiently restrained only by the first adhesive A1. The second adhesive A2 has a higher elastic modulus than the first adhesive A1 at the second temperature T2. Accordingly, the support substrate 5 is strongly restrained is a step in which the support substrate 5 is thermally deformed and a large thermal deformation of the support substrate 5 in the temperature range ΔT can be suppressed. Meanwhile, the thermal deformation of the support substrate 5 is not large between the first temperature T1 and the second temperature T2. Accordingly, the thermal deformation of the support substrate 5 can be sufficiently suppressed only by the first adhesive A1. As described above, in the present embodiment, the support substrate 5 can be positioned with high accuracy and bonded to the support substrate 2. The above-described phenomenon can occur even if the elastic modulus of the first adhesive A1 does not decrease in a range from the first temperature T1 to the second temperature T2. Accordingly, curing properties of the first adhesive A1 are not an essential requirement of the present disclosure.

In the present embodiment, the two second adhesives A2 are disposed in the vicinity of the major axis AL of the support substrate 5. As described above, the support substrate 5 is thermally deformed most largely in the vicinity of the major axis AL. This means that the first vertex V1 and the third vertex V3 of the support substrate 5 move largely in the X direction. As a result, the support substrate 5 is deformed so as to rotate around the center of gravity G. Accordingly, it is possible to effectively suppress the rotational deformation by restricting the movements of the first vertex V1 and the third vertex V3 in the X direction. For this reason, in the present embodiment, the two second adhesives A2 are disposed in the vicinities of the first vertex V1 and the third vertex V3 of the element substrate 3.

In Example 1, a rotation angle of the element substrate 3 was measured. An assembly 11 in which 36 element substrates 3 were disposed on the support substrate 2 in the Y direction was prepared and as illustrated in FIG. 2B, alignment marks AM1 and AM2 were provided in the vicinity of the third vertex V3 and the vicinity of the fourth vertex V4 of each substrate 4. The assembly 11 was heated from the first temperature T1 (25° C.) to the third temperature T3 (105° C.), distances x1 and x2 in the X direction from a reference axis BL substantially parallel to the Y axis to the alignment marks AM1 and AM2 were measured and a difference x3=x2−x1 between x1 and x2 before and after the heating was obtained. x3 was obtained as an average value of 36 element substrates 3. The difference Δx3 between x3 before the heating and x3 after the heating is an index indicating an amount of rotation of the element substrate 3. As a comparative example, an assembly 11 in which the second adhesive A2 was not provided was prepared and the same measurement was performed. The difference Δx3 was 1.4 μm in the comparative example, while the difference Δx3 was 0.5 μm in the example. It is assumed that the support substrate 5 is completely fixed to (thermal deformation stops) the support substrate 2 by the second adhesive A2 at the second temperature T2 (70° C.), Δx3 at 105° C. is expected to be about 56% (=(70−25)/(105−25)) of a case where the second adhesive A2 is not provided. In the example, an effect equal to or more than this expected value was confirmed.

Second Example Embodiment

Figure 8A:
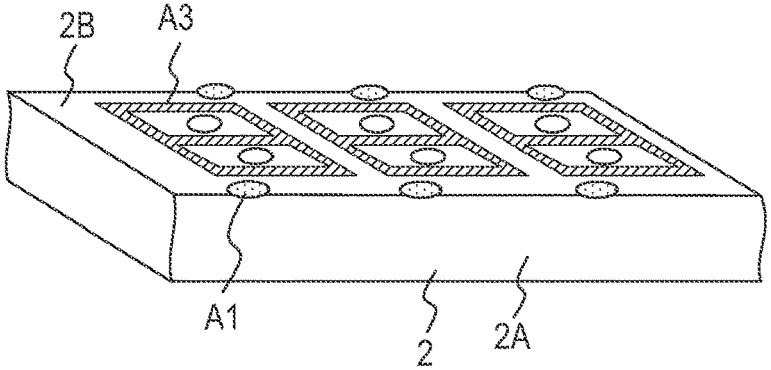
FIGS. 8A, 8B and 8C are step diagrams of a manufacturing method of a liquid ejecting head according to a second example embodiment.
Figure 8B:
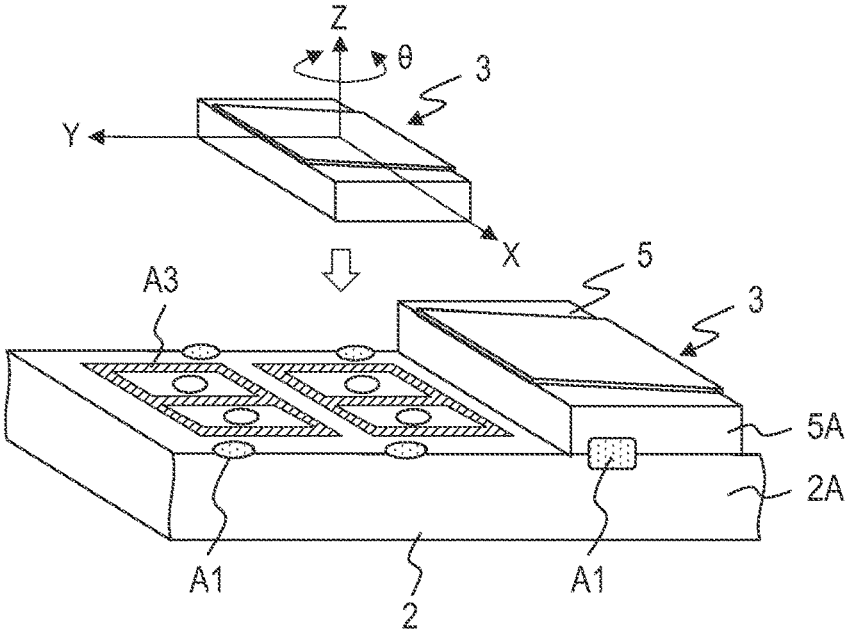
Figure 8C:
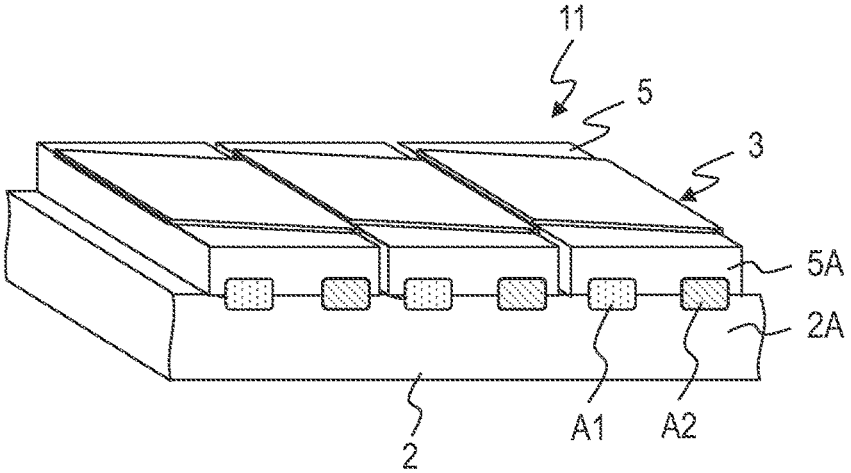
Figure 9:
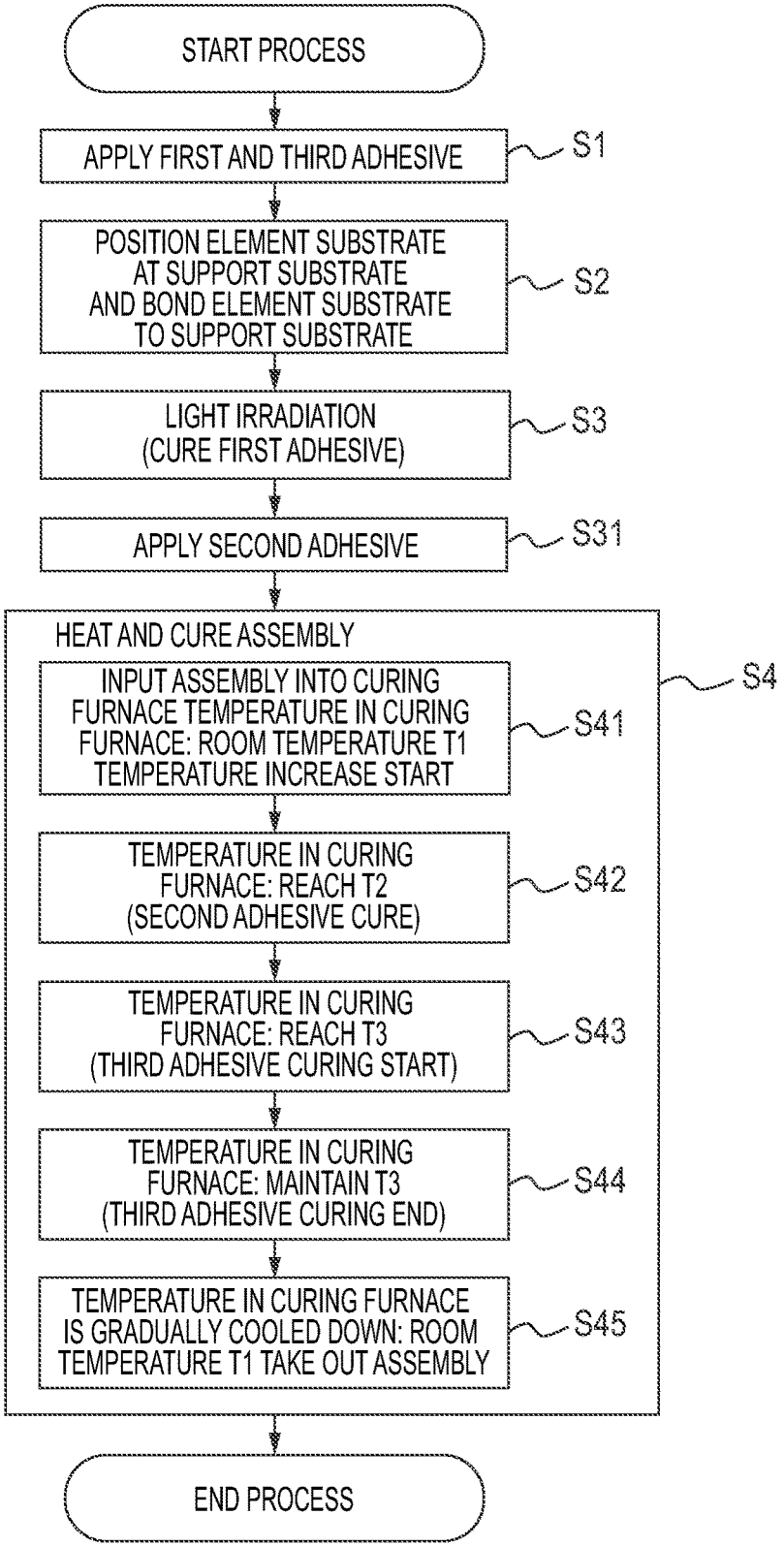
FIG. 9 is a flowchart of the manufacturing method of the liquid ejecting head according to the second example embodiment.

A method for bonding the element substrate 3 to the support substrate 2 according to a second embodiment will be described. FIGS. 8A to 8C are step diagrams similar to FIGS. 3A to 3C illustrating the bonding method and FIG. 9 is a flowchart similar to FIG. 4 illustrating the bonding method. In the present embodiment, the first adhesives A1 and the third adhesive A3 are formed between the support substrate 2 and the element substrate 3 before the first temporary fixing is performed. However, the second adhesive A2 is formed between the support substrate 2 and the element substrate 3 between the first temporary fixing and the second temporary fixing. Configurations, steps and effects of which descriptions are omitted are the same as those of the first embodiment.

First, as illustrated in FIG. 8A, the first liquid adhesives A1 and the third liquid adhesive A3 are applied to the bonding surface 2B of the support substrate 2 (Step S1). In this case, the second adhesive A2 is not applied to the bonding surface 2B of the support substrate 2. Next, as illustrated in FIG. 8B, the element substrate 3 is positioned and the first adhesives A1 and the third adhesive A3 are pressed against the element substrate 3 (Step S2). The first adhesives A1 are pressed by the element substrate 3. Accordingly, a portion of the first adhesive A1 protrudes to the side surface 2A of the support substrate 2 and the side surface 5A of the support substrate 5. The third adhesive A3 is pressed by the element substrate 3, and thus, spreads to the space between the support substrate 2 and the support substrate 5. Next, the first adhesive A1 is irradiated with ultraviolet rays at the first temperature T1 (room temperature) to cure the first adhesive A1 (Step S3). Thus, the first temporary fixing of the element substrate 3 to the support substrate 2 is performed.

Next, as illustrated in FIG. 8C, the second liquid adhesive A2 is applied so as to straddle the side surface 2A of the support substrate 2 and the side surface 5A of the support substrate 5 (Step S31). A portion of the second adhesive A2 enters the space between the support substrate 2 and the support substrate 5 due to a surface tension and the rest remains on the side surface 2A of the support substrate 2 and the side surface 5A of the support substrate 5. Thereafter, the assembly 11 is installed in the curing furnace 12 and heated to the third temperature T3 via the second temperature T2 (Step S4). Step S4 is performed in the same manner as in the first embodiment. The second adhesive A2 is cured at the second temperature T2 and the second temporary fixing of the element substrate 3 to the support substrate 2 is performed. Thereafter, the third adhesive A3 is cured at the third temperature T3 and the element substrate 3 is bonded to the support substrate 2.

In order to increase the elastic modulus of the second adhesive A2, for example, a solid such as a filler may be added to the second adhesive A2. In a case where the solid cannot be sufficiently crushed by pressing the element substrate 3, a minimum thickness of the third adhesive A3 may be restricted, or a thickness of the third adhesive A3 may vary. In the present embodiment, the second adhesive A2 is applied after the element substrate 3 is mounted on the support substrate 2 and the first adhesive A1 is irradiated with light. Accordingly, the above-described problem hardly occurs. Compared with the first embodiment, in the present embodiment, a timing of applying the second adhesive A2 is merely shifted. Accordingly, the number of processes hardly increases.

Third Example Embodiment

In the present embodiment, the first adhesive A1 further contains a thermosetting component. The first adhesive A1 is an ultraviolet curable/thermosetting adhesive and the second and third adhesives A2 and A3 are thermosetting adhesives. Bonding of the element substrate 3 to the support substrate 2 can be performed in the same manner as in the first embodiment or the second embodiment. As is clear from FIGS. 1A to 2B or the like, ultraviolet rays do not reach the first adhesive A1 provided in the space between the support substrate 5 and the support substrate 2. In the present embodiment, the first adhesive A1 contains a thermosetting component in addition to an ultraviolet curing component. Accordingly, it is possible to cure a portion of the first adhesive A1 which has not been cured by the ultraviolet irradiation during the heating in the curing furnace 12.

Figure 10:
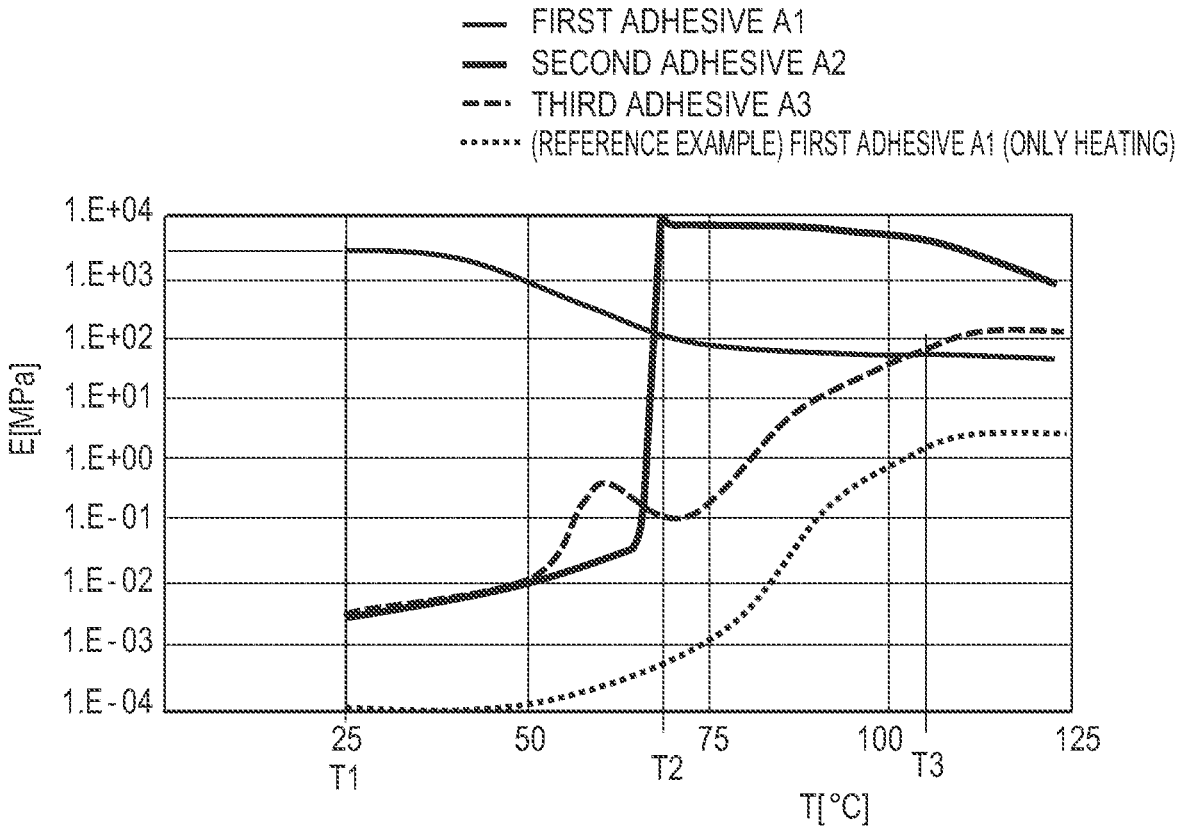
FIG. 10 is a graph illustrating an example of a measurement result of temperatures and elastic modulus of first to third adhesives.

FIG. 10 illustrates an example in which a relationship (temperature curing properties) between the temperatures and the elastic modulus (longitudinal elastic modulus E) of the first to third adhesives A1 to A3 is measured by an analyzer. A horizontal axis indicates the temperature and a vertical axis indicates the elastic modulus. An ultraviolet curable/thermosetting adhesive was used as the first adhesive A1, the first adhesive A1 was irradiated with an ultraviolet irradiation amount of 0.7 W/mm$^2$ at the room temperature for 10 seconds, and thus, the first adhesive A1 was cured. The same thermosetting adhesives as those of FIG. 7 were used for the second and third adhesives A2 and A3. For reference, the curing properties of the first adhesive A1 cured only by heat without irradiation with ultraviolet rays are also illustrated. The temperature curing properties of the first adhesive A1 were substantially the same as those of the first adhesive A1 made of an ultraviolet curing resin illustrated in FIG. 7. The first adhesive A1 of a reference example was cured in the vicinity of the third temperature T3 by heating. However, the elastic modulus at the third temperature T3 was about several % of the first adhesive A1 subjected to ultraviolet irradiation and a sufficient elastic modulus could not be obtained only by heating. From FIGS. 7 and 10, it was confirmed that either an ultraviolet curable type adhesive or an ultraviolet curable/thermosetting type adhesive functioning as the first adhesive A1 can be used as the first temporary fixing adhesive.

Figure 11:
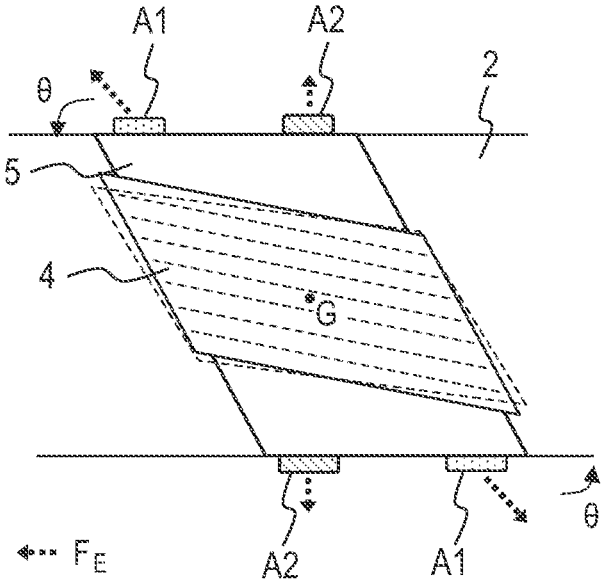
FIG. 11 is a plan view of an element substrate in Example 3.

In Example 2, the rotation angle of the element substrate 3 was measured by the same method as in Example 1. A difference between Δx3 before heating and Δx3 after heating was 0.5 μm as in Example 1. Further, as Example 3, as illustrated in FIG. 11, an assembly 11 in which the disposition of the first adhesive A1 and the second adhesive A2 was reversed was prepared and a difference between Δx3 before heating and Δx3 after heating was calculated. The difference was 1.0 μm, which was smaller than 1.4 μm in the comparative example, but was larger than 0.5 μm in Example 2. As described in the first embodiment, this is because the rotational deformation of the support substrate 5 in Example 2 is further suppressed than in Example 3.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-078629, filed Apr. 17, 2019, which is hereby incorporated by reference herein in its entirety.

What is claimed is:

1. A manufacturing method of a liquid ejecting head, comprising:

curing a first adhesive, which is in contact with an element substrate having an ejection orifice through which a liquid is ejected and a support substrate, at a first temperature to perform first temporary fixing of the element substrate to the support substrate;

heating a second adhesive, which is in contact with the element substrate and the support substrate subjected to the first temporary fixing, to a second temperature higher than the first temperature so as to cure the second adhesive and perform second temporary fixing of the element substrate to the support substrate; and heating a third adhesive, which is in contact with the element substrate and the support substrate subjected to the second temporary fixing, to a third temperature higher than the second temperature so as to cure the third adhesive and bond the element substrate to the support substrate, wherein an elastic modulus of the second adhesive is larger than an elastic modulus of the first adhesive at the second temperature.

2. The manufacturing method of a liquid ejecting head according to claim 1, wherein the elastic modulus of the second adhesive is larger than the elastic modulus of the first adhesive at any temperature from the second temperature to the third temperature.

3. The manufacturing method of a liquid ejecting head according to claim 1, wherein the elastic modulus of the first adhesive at the second temperature is smaller than the elastic modulus of the first adhesive at the first temperature.

4. The manufacturing method of a liquid ejecting head according to claim 1, wherein the first to third adhesives are applied before the first temporary fixing is performed.

5. The manufacturing method of a liquid ejecting head according to claim 4, wherein the first to third adhesives are applied to a surface of the support substrate bonded to the element substrate, the first and second adhesives are pressed by the element substrate such that a portion of each of the first and second adhesives protrudes to a side surface of the support substrate and a side surface of the element substrate and the third adhesive is pressed by the element substrate to spread to a space between the support substrate and the element substrate.

6. The manufacturing method of a liquid ejecting head according to claim 1, wherein the first and third adhesives are applied before the first temporary fixing is performed and the second adhesive is applied between the first temporary fixing and the second temporary fixing.

7. The manufacturing method of a liquid ejecting head according to claim 6, wherein the first and third adhesives are applied to a surface of the support substrate bonded to the element substrate, the first adhesive is pressed by the element substrate such that a portion of the first adhesive protrudes to a side surface of the support substrate and a side surface of the element substrate, the third adhesive is pressed by the element substrate to spread to a space between the support substrate and the element substrate and the second adhesive is applied so as to straddle the side surface of the support substrate and the side surface of the element substrate such that a portion of the second adhesive enters the space.

8. The manufacturing method of a liquid ejecting head according to claim 1, wherein the first adhesive contains a photocurable component and the second and third adhesives contain a thermosetting component.

9. The manufacturing method of a liquid ejecting head according to claim 8, wherein the first adhesive further contains a thermosetting component.

10. The manufacturing method of a liquid ejecting head according to claim 1, wherein the element substrate includes a substrate which is obtained by stacking an ejection orifice forming member in which the ejection orifice is formed and a base having an energy generating element for ejecting the liquid, and another support substrate which supports the substrate, is bonded to the support substrate and is different from the support substrate, and the other support substrate has a quadrilateral shape which includes first and third vertices facing each other, second and fourth vertices facing each other, a major axis connecting the first vertex and the third vertex to each other, a minor axis connecting the second vertex and the fourth vertex to each other, a first side connecting the first vertex and the second vertex to each other and a second side connecting the third vertex and the fourth vertex to each other, and wherein the first adhesive is provided at a second position of the first side close to the second vertex and a fourth position of the second side close to the fourth vertex and the second adhesive is provided at a first position of the first side close to the first vertex and a third position of the second side close to the third vertex.

11. The manufacturing method of a liquid ejecting head according to claim 10, wherein a first straight line connecting the first position and the third position to each other and a second straight line connecting the second position and the fourth position to each other together pass through a center of gravity of the substrate.

12. The manufacturing method of a liquid ejecting head according to claim 11, wherein the first side and the second side are parallel to each other, and the second straight line is orthogonal to the first and second sides.

13. The manufacturing method of a liquid ejecting head according to claim 1, wherein each of a plurality of the element substrates is temporarily fixed to the support substrate by the first and second adhesives and is bonded to the support substrate by the third adhesive.

14. A liquid ejecting head comprising:

an element substrate including an ejection orifice through which a liquid is ejected;

a support substrate which supports the element substrate; and first to third adhesives which are in contact with the element substrate and the support substrate to bond the element substrate to the support substrate, wherein the first adhesive has temperature curing properties to be cured at a first temperature, the second adhesive has temperature curing properties to be heated and cured at a second temperature higher than the first temperature, the third adhesive has temperature curing properties to be heated and cured at a third temperature higher than the second temperature and an elastic modulus of the second adhesive at the second temperature is larger than an elastic modulus of the first adhesive at the second temperature.

15. The liquid ejecting head according to claim 14, wherein the elastic modulus of the second adhesive is larger than the elastic modulus of the first adhesive at any temperature from the second temperature to the third temperature.

16. The liquid ejecting head according to claim 14, wherein the first adhesive contains a photocurable component and the second and third adhesives contain a thermosetting component.

17. The liquid ejecting head according to claim 16, wherein the first adhesive further contains a thermosetting component.

18. The liquid ejecting head according to claim 14, wherein the element substrate includes a substrate which is obtained by stacking an ejection orifice forming member in which the ejection orifice is formed and a base having an energy generating element for ejecting the liquid, and another support substrate which supports the substrate, is bonded to the support substrate and is different from the support substrate, and the other support substrate has a quadrilateral shape which includes first and third vertices facing each other, second and fourth vertices facing each other, a major axis connecting the first vertex and the third vertex to each other, a minor axis connecting the second vertex and the fourth vertex to each other, a first side connecting the first vertex and the second vertex to each other and a second side connecting the third vertex and the fourth vertex to each other, and wherein the second adhesive is provided at a first position of the first side close to the first vertex and a third position of the second side close to the third vertex and the first adhesive is provided at a second position of the first side close to the second vertex and a fourth position of the second side close to the fourth vertex.

19. The liquid ejecting head according to claim 18, wherein a first straight line connecting the first position and the third position to each other and a second straight line connecting the second position and the fourth position to each other together pass through a center of gravity of the substrate.

* * * * *